US006726824B1

(12) United States Patent
Khosla

(10) Patent No.: US 6,726,824 B1
(45) Date of Patent: Apr. 27, 2004

(54) CLOSED LOOP MONITORING OF ELECTROPLATING BATH CONSTITUENTS USING MASS SPECTROMETRY

(75) Inventor: Mukul Khosla, San Jose, CA (US)

(73) Assignee: Novellus Systems, Inc., San Jose, CA (US)

( * ) Notice: Subject to any disclaimer, the term of this patent is extended or adjusted under 35 U.S.C. 154(b) by 423 days.

(21) Appl. No.: 09/833,385

(22) Filed: Apr. 11, 2001

(51) Int. Cl.[7] ..... C25D 21/12; C25D 5/00
(52) U.S. Cl. ..... 205/82; 205/81; 205/84
(58) Field of Search ..... 205/81, 82, 84

(56) References Cited

U.S. PATENT DOCUMENTS

| | | | | |
|---|---|---|---|---|
| 5,352,350 A | | 10/1994 | Andricacos et al. | |
| 5,644,131 A | * | 7/1997 | Hansen | 250/292 |
| 6,458,262 B1 | * | 10/2002 | Reid | 205/82 |
| 2002/0033340 A1 | * | 3/2002 | Cheung et al. | 205/101 |
| 2002/0060157 A1 | * | 5/2002 | Calvert et al. | 205/82 |

OTHER PUBLICATIONS

Taylor, et al, "Electroplating bath control for copper interconnects", Solid State Technology, Nov. 1998, pp. 47–57.

Wikiel, et al., "On–Line Monitoring of Chemical Processes in Electronic Components Manufacturing", Technic, Inc., pp. 1–8, no date available.

Paar, Anton, "L–DENS–Liquid Density Transmitter for OEM Applications (Original Equipment Manufacturer)", Instruction Book, Mar. 12, 1996, pp. 1–30.

"Quali–Line™ AC–1000", ECI Technology, 1993, pp. 1–2, no month available.

Bratin, Peter, "New Development in the Use of Cyclic Voltammetric Stripping for Analysis of Plating Solutions", pp. N1–N28, no date available.

"Real Time Analyzer (RTA) Technical Manual", Technic, of Providence, Rhode Island, pp. 1–19, no date available.

* cited by examiner

*Primary Examiner*—Wesley A. Nicolas
(74) *Attorney, Agent, or Firm*—Beyer Weaver & Thomas, LLP

(57) ABSTRACT

The present invention provides methods and apparatus for analysis and monitoring of electrolyte bath composition. Based on the results of the analysis, the invention controls electrolyte bath composition and plating hardware. Thus, the invention provides control of electroplating processes based on plating bath composition data. The invention accomplishes this by incorporating mass spectral analysis into a feedback control mechanism for electroplating. Mass spectrometry is used to identify plating bath conditions and based on the results, the plating bath formulation and plating process are controlled.

18 Claims, 4 Drawing Sheets

CLOSED LOOP MONITORING OF ELECTROPLATING BATH CONSTITUENTS USING MASS SPECTROMETRY

FIELD OF THE INVENTION

This invention relates to silicon wafer electroplating and mass spectrometry analysis technology. More specifically, it relates to analysis of electroplating bath constituents during integrated circuit fabrication. Even more specifically, the invention pertains to a particular monitoring and feedback system used for analysis and control of electroplating bath formulations.

BACKGROUND OF THE INVENTION

Improved integrated circuit fabrication processes continue to necessitate more complex and demanding control of process parameters to ensure wafer uniformity and quality. Electroplating is a good example. Electroplating for integrated circuit fabrication is typically performed in a series of plating steps, with each having a particular hardware configuration and specific plating bath formulation. Often bath formulations include not only metal salts, but also acids, bases, organic additives and the like. More than ever, it is critical to monitor plating bath electrolyte constituents and maintain bath formulations within a specific range of parameters to ensure the desired outcome and quality of a particular plating process.

Conventional methods of assaying bath constituents commonly employ cyclic voltammetric stripping (CVS) or other forms of Faradaic electroanalysis, which have limitations in specificity and sensitivity. For example, voltammetric analyses suffer from lack of detection capability for compounds and ions that are not electrochemically active over the range of potentials used Also, many of the organic additives commonly used in some electroplating scenarios to alter the rate of metal deposition can not be detected using such techniques. In such cases, a true "picture" of plating bath chemistry is not obtained using voltammetric analyses. Additionally, voltammetric analyses are sensitivity-limited by matrix effects (convoluted electrochemical interactions due to the response of breakdown products).

High-pressure liquid chromatography (HPLC) has been proposed as a method to monitor plating bath constituents by Taylor et al. "Electroplating Bath Control for Copper Interconnects," *Solid State Technology*, vol. 4, issue Nov. 11, 1998. In this article, the authors describe using HPLC to separate electrolyte species. Although HPLC techniques have improved dramatically over the past decade, this type of analysis has limitations with regard to plating bath composition as well. While organic additives are well suited for chromatographic separation, metals, metal salts, and important ionic bath species are not. Analysis of purified bath components via chromatography can provide valuable information about plating bath chemistry, but, a more complete "picture" of the bath chemistry is obtained only from analysis of "intact" plating bath samples. Also HPLC techniques tend to use large amounts of solvent, which is of environmental concern and creates costs associated with waste disposal.

Thus, while CVS and HPLC techniques are complementary with regard to which plating bath constituents can be analyzed, neither analysis giving information on all bath components.

Another problem associated with conventional plating bath analysis is time, or more specifically turnaround.

Although voltammetric analysis and HPLC techniques have improved to include shorter analysis time frames, the time necessary for these analyses as compared to the time frame of possible change in a plating bath composition can be inadequate. Under such conditions, data regarding composition change obtained from plating bath analysis is rendered useless because the data may no longer reflect the actual bath formulation. This can be particularly problematic when such data is used to adjust bath component stoichiometries, i.e. the stoichiometry imbalance noted in the analysis can be compounded by addition of bath components based on inaccurate data.

What is needed therefore is improved technology for analysis and control of electroplating bath formulations during electroplating and electroplating processes during integrated circuit fabrication.

SUMMARY OF THE INVENTION

The present invention provides methods and apparatus for monitoring and controlling electrolyte bath composition. The invention also provides control of electroplating processes based on plating bath composition data. The invention accomplishes this by incorporating mass spectral analysis into a feedback control mechanism for electroplating. Mass spectrometry is used to identify plating bath conditions and based on the results, the plating bath formulation and plating process are controlled.

One aspect of the invention pertains to a method of using atmospheric pressure ionization mass spectrometry, API-MS. Mass spectrometry is particularly well suited to analysis of plating bath constituents because it does not share many of the limitations of the aforementioned methods. For example, mass spectral analysis is not limited by matrix effects. Also, sample volumes necessary to carry out a mass spectral analysis are typically very small. Turnaround is very short, making close-loop process control via constant bath analysis feasible. Additionally, mass spectrometry can detect molecules not easily ionized by using post-bath addition of ionization enhancers. Mass spectral analysis provides a more complete "picture" of plating bath chemistry, because organic additives, metals, and their salts are easily detected. Thus, electroplating chemistries, mechanisms, and kinetics can be better characterized. Finally, by using an atmospheric pressure ionization source, plating baths can be easily sampled without undue modification of existing plating apparatus.

Of course other MS techniques can be employed in the method. Suitable techniques would include Ion Trap Quadrupole (single and triple quad), Magnetic Sector, Time-Of-Flight (TOF), Fourier-Transform MS (FT-MS), and the like.

Another aspect of this invention pertains to methods of controlling an electroplating process. These methods may be characterized by the following elements: (a) obtaining a sample of electrolyte from the electroplating process; (b) analyzing the sample of electrolyte by mass spectrometry to obtain a mass spectral result; (c) comparing the mass spectral result to a plurality of known mass spectral results; and (d) adjusting conditions of the electroplating process in response to the comparison. Electrolyte sampling may be done directly from a plating bath or from a separate vessel that serves as a collector of a small quantity of electrolyte.

Another aspect of this invention pertains to the logic associated with using mass spectral data for feedback control of an electroplating process. Preferably data from a mass spectral analysis is stored in a memory device. Then the data is compared to a data set of known mass spectral results (provided from plating bath compositions comprising organic plating additives, breakdown products of said additives, metals, metal ions, counter ions, and the like). Thus, a library search method is used as an element in the feedback control invention. The comparison involves comprises determining whether the data from the mass spectral analysis falls within a specified tolerance of a target result that is one of the data set of known mass spectral results. From the comparison, the logic determines commands for controlling the electroplating process. As mentioned, the invention finds particular use in the context of copper electroplating. Copper electroplating during damascene processing is becoming increasingly important and complex. The logic of the invention provides an efficient method of monitoring and controlling individual plating bath (many at once) chemistry and hardware during electroplating. This allows for improvement in throughput and wafer uniformity.

Yet another aspect of this invention pertains to apparatus for controlling an electroplating process. In certain embodiments the apparatus may be characterized by the following elements: (a) a mass spectrometer equipped with an electrolyte sampling device and an ionization source configured to deliver a sample of ionized electrolyte to the mass spectrometer, and (b) an associated logic for controlling the electroplating process based on a plurality of data obtained from the mass spectrometer upon analysis of the sample of ionized electrolyte. Preferably, the control element comes in the form of commands sent to plating hardware by the logic as a result of a comparison of the plurality of data obtained from the mass spectrometer with a known plurality of mass spectral data. The associated logic of the apparatus controls plating hardware through adjustment, for example valves for introducing plating bath constituents and formulations, electric field shaping apparatus, current flow, voltage levels, wafer handling apparatus, and electrode movement apparatus. Apparatus of the invention may sample electrolyte directly from a plating bath or indirectly, by use of an intermediary sample collection vessel. In many cases, individual components of the apparatus can be purchased commercially. Their configuration and programming constitute novelty in this case. The associated logic may be implemented in any suitable manner. Often it will be implemented in computer hardware and associated software for controlling the operation of the computer.

Further, the method and apparatus of the invention can be used for feedback control for other wet processes for silicon wafers in integrated circuit fabrication in which wafers are processed in a solution. For example, electroplanarization and wet etching (such as buffered oxide etch or BOE). In such wafer wet processes, API-MS in particular is well suited as an analytical tool for providing feedback control.

These and other features and advantages of the present invention will be described in more detail below with reference to the associated figures.

BRIEF DESCRIPTION OF THE DRAWINGS

The following detailed description can be more fully understood when considered in conjunction with the drawings in which.

DETAILED DESCRIPTION OF THE PREFERRED EMBODIMENTS

In the following detailed description of the present invention, numerous specific embodiments are set forth in order to provide a thorough understanding of the invention. However, as will be apparent to those skilled in the art, the present invention may be practiced without resort to some of these specific details or by using alternate elements or processes. For example an electrospray ionization source is described as a component of the apparatus of the invention, although a preferred embodiment, alternative ionization sources such as an Inductively-Coupled Plasma (ICP) torch or Atmospheric Pressure Chemical Ionization (APCI) can be used. In some descriptions herein, well-known processes, procedures, and components have not been described in detail so as not to unnecessarily obscure aspects of the present invention.

Figure 1:
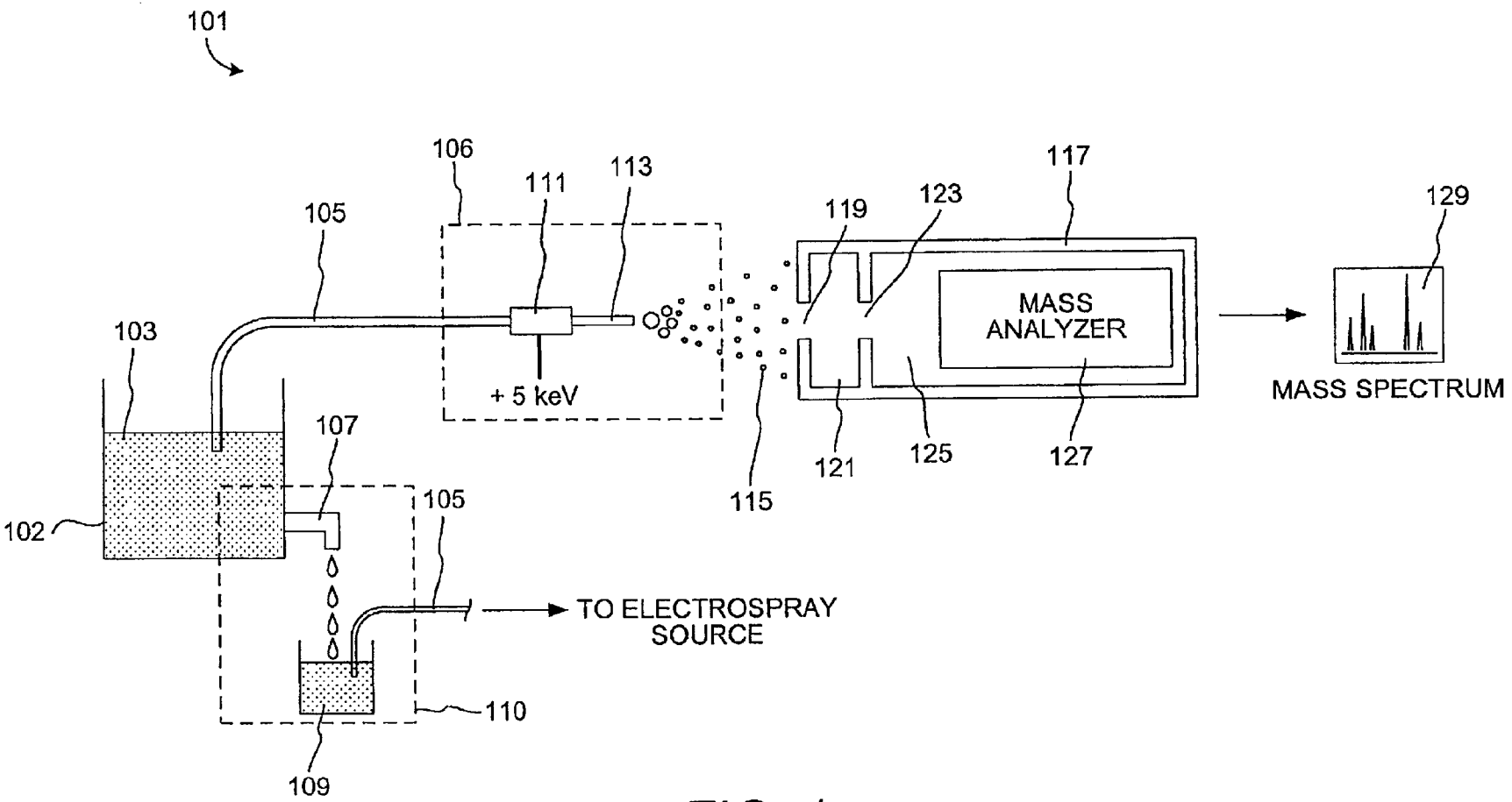
FIG. 1 depicts an atmospheric pressure ionization source for sampling plating bath electrolyte and providing charged species to a mass spectrometer.

Aspects of the invention feature a method for monitoring electrolyte plating bath chemistry and providing feedback to an electroplating apparatus for the purpose of adjusting bath components and controlling the plating process. In a preferred embodiment, API-MS is used because it simplifies the sampling hardware component of the apparatus. FIG. 1 depicts an API-MS apparatus 101 for sampling a plating bath electrolyte and providing charged species to a mass spectrometer. The major components are a plating vessel 102 containing a plating bath 103, an electrospray ionization source (depicted within the dashed line rectangle 106), and a mass spectrometer 117. Mass spectrometer 117 includes a sampling orifice 119, a low pressure (on the order of 0.1 torr) internal region 121, a focusing orifice 123, a very low pressure (on the order of $10^{-5}$ torr) internal region 125, and a mass analyzer 127. Examples of suitable commercially available mass spectrometers include those from Varian Inc. of Palo Alto, Calif.; ThermoFinnigan of San Jose, Calif.; and Sciex of Toronto, Canada.

Plating bath 103 is sampled via a capillary tube 105. Preferably 105 is made of fused silica to resist the corrosive properties of the electrolyte. Liquid electrolyte travels from the plating bath to the ionization source (depicted within dashed line rectangle 106) by electrophoretic means, that is, driven by a voltage gradient along tube 105. Alternatively, the ionization source can be enclosed in a slightly sub-atmospheric chamber such that atmospheric pressure can push electrolyte through capillary 105 due to the pressure differential. In an alternative embodiment, capillary 105 may receive electrolyte from bath 103 via a separate sampling vessel 109, fed from gravity drip outlet 107 (as depicted within dashed line rectangle 110).

Tube 105 is fitted with a metal union 111, which connects it to a metal tube 113. A high voltage (e.g., a +5 kV potential) is applied to union 111 so that molecules and atoms passing through it in the electrolyte stream are ionized. Note that the length and internal diameter of capillary 105 are designed to embody enough resistance so that the high voltage is isolated to the ionization source. Alternatively, a grounded union can be attached between metal union 111 and bath 103 to prevent the high voltage from getting to the bath. Electrolyte passes through 111 and its constituents are ionized. The ionized electrolyte passes through metal tube 113 and is atomized to provide a fine spray of charged particles 115 to mass analyzer 127 via orifices 119 and 123.

Details of mass spectrometry theory are well-known to those of skill of the art and will not be reiterated here, except to mention that ions are analyzed according to their mass to charge ratio and a data set is collected and converted to a usable form via computer in the form of a mass spectrum, 129. Mass spectrum 129 can provide a "fingerprint" of plating bath chemistry in terms of the ions produced from inorganic species, organic additives, metals, and their fragmentation patterns. Mass spectrum 129 (the fingerprint) can be compared to a known set of mass spectra (fingerprints) collected from bath chemistry formulation standards. Based on the results of that comparison, logic is derived to control plating bath chemistry and the plating process.

Figure 2:
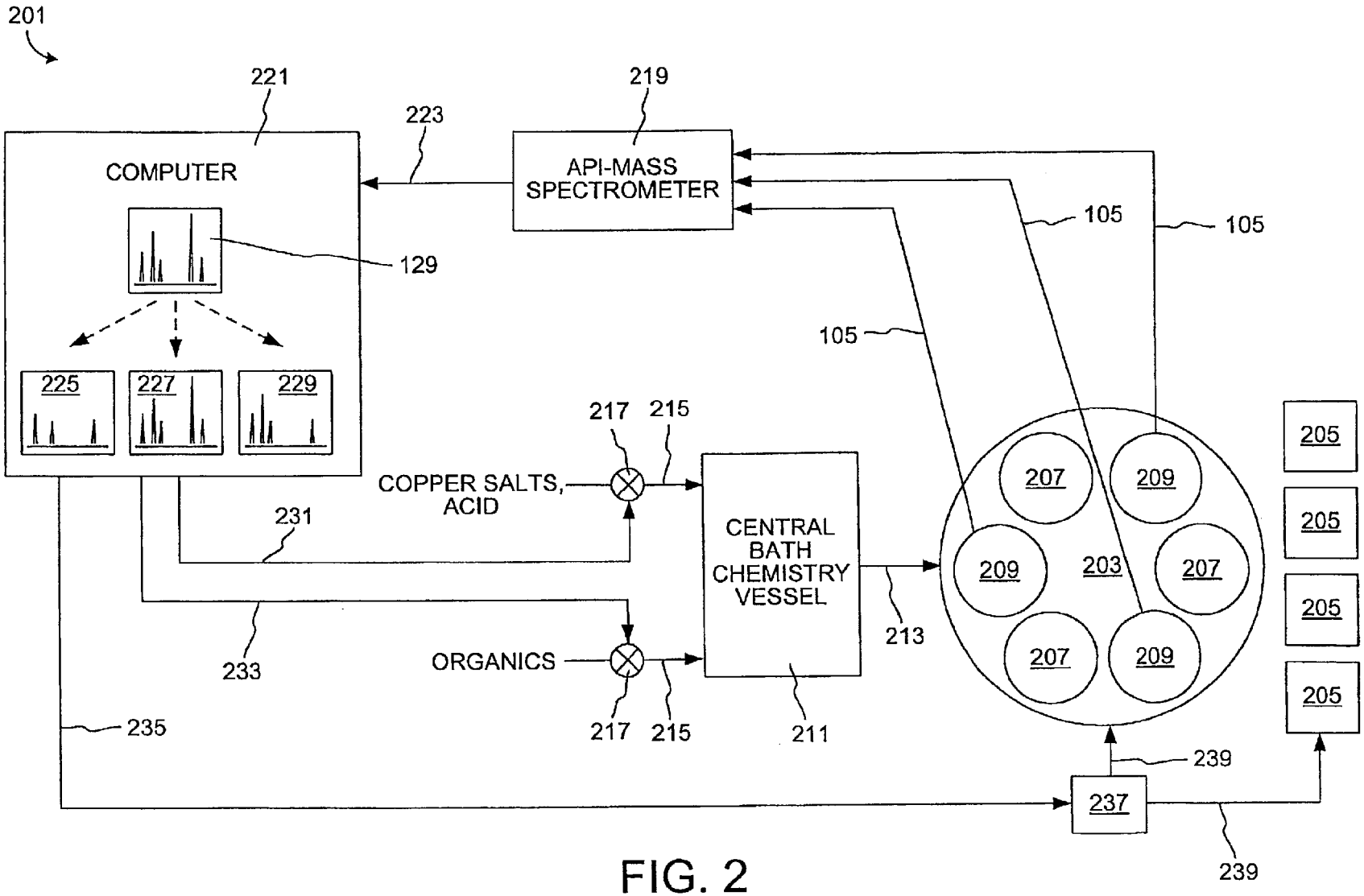
FIG. 2 depicts a block diagram of a hardware configuration used to perform the method of the invention.

FIG. 2 depicts a block diagram of a hardware configuration 201 that may be used to perform the method of the invention. An electroplating apparatus 203 (such as the SABRE™ clamshell electroplating apparatus available from Novellus Systems, Inc. of San Jose, Calif.) has wafer loading stations 205, three rinse-EBR (edge bevel removal) stations 207, and three electroplating cells 209. Electroplating cells 209 are typically configured to electroplate three silicon wafers simultaneously. In this embodiment of the invention, each plating cell 209 is fitted with a sampling tube 105 as described above for FIG. 1. Plating cells 209 are sampled using apparatus as described in FIG. 1, for example. Capillaries 105, feed bath electrolyte to API-mass spectrometer 219 (which includes an atmospheric pressure ionization source). In an alternative embodiment, electrolyte can be sampled directly from chemistry vessel 211 (which supplies electrolyte to plating cells 209) via a single sampling tube 105. Because only very small sample volumes are required for mass spectrometry, corresponding waste streams are also relatively small and easily managed. Modern mass spectrometer technology allows high throughput sample analysis, and thus all three plating baths can be analyzed continuously. Additionally, because of the high throughput technology, the invention can be used to monitor and control multiple plating baths from multiple apparatus like 203. For clarity this more simplified example (showing only one electroplating apparatus 203) of the "closed-loop" monitoring and control invention is depicted.

Computer 221 receives mass spectral data from mass spectrometer 219, via communication line 223. Computer 221 processes input mass spectral data and controls plating hardware via communication lines 231, 233, and 235; thus completing the feedback communication component of the "closed-loop." Communication lines 231 and 233 are used to send commands from computer 221 to control valves 217, which in turn control the flow of bath constituents (copper salts, acid, organics, etc.) into a central bath chemistry vessel 211, via feed lines 215; thus completing the control component of the "closed-loop." Chemistry vessel 211 is a centralized mixing chamber for pre-mixing electrolyte formulations before feeding them into cells 209 via a line 213. In this example, all three plating cells, 209, receive electrolyte via line 213. Communication line 235 connects computer 221 with a communication bus 237. Bus 237 feeds commands to plating hardware (not shown) to toggle power source switches, adjust plating currents, load/unload wafers, etc. through communication lines 239. Thus, computer 221 is a system controller for the plating apparatus and process.

In this case, a target spectra 129 (also depicted in FIG. 1) is generated by computer 221 from data collected from analysis of an electrolyte sample from one of the plating cells 209. The logic of the invention compares spectra 129 to known standards and based on the comparison, commands plating hardware to perform specific tasks. For example, if 129 is found to closely match a standard 227 (which is representative of the desired bath formulation for optimal electroplating), then plating hardware can be instructed (via 237) to continue plating or to cease electroplating after a pre-set time period has ended. If 129 is found to closely match a standard 225 (which is representative of a poor bath formulation), then plating hardware can be instructed (via 237) to cease electroplating immediately. Alternatively, if 129 is found to closely match a standard 229 (which is representative of a non-optimal but acceptable bath formulation for electroplating), then plating hardware can be instructed to continue electroplating, but adjust the plating bath formulation (via 211) for the bath in question. Alternatively, commands to plating hardware might include adjusting current flow, field shaping apparatus, voltage levels, distance between anode and cathode, rotation rate of the anode or cathode, electrolyte flow characteristics (if any), and the like.

The mass spectra output by spectrometer 219 may also be used to directly determine the composition of the plating bath, without resort to specific stored spectra. However, it will typically be more computationally efficient to simply compare sample spectra against one or more known spectra for different expected plating bath compositions.

Any number of plating hardware feedback control scenarios can be used with this invention. Mass spectrometry provides fast, accurate, and meaningful analysis of plating bath constituents. By incorporating this type of analysis into plating bath hardware configurations, the invention achieves an efficient feedback control mechanism and improves wafer process uniformity and throughput. The feedback control method of the invention can be applied to other wafer wet processes as well.

Figure 3:
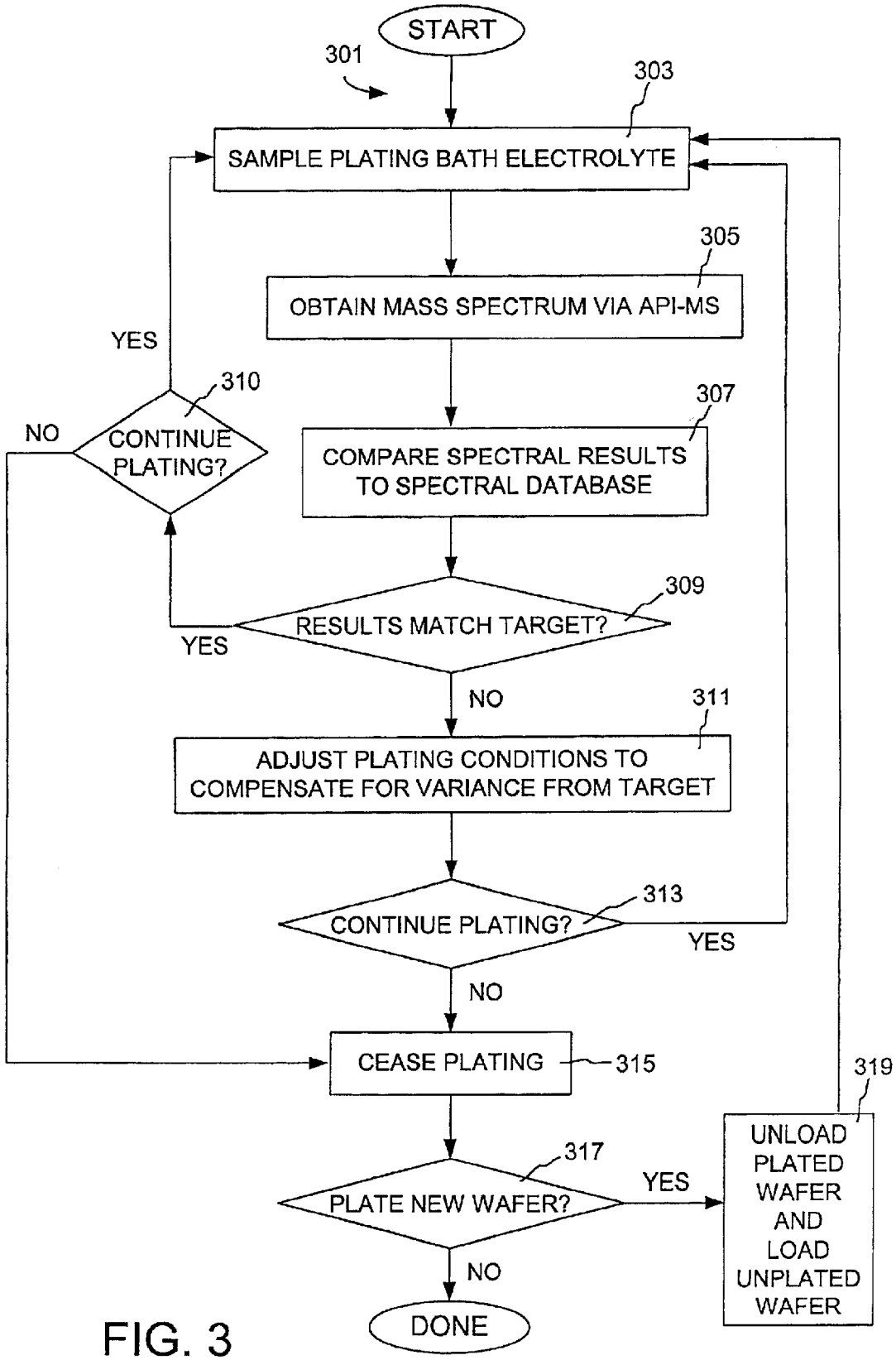
FIG. 3 is a flowchart of the monitoring and feedback control method of the invention.

FIG. 3 is a flowchart of a monitoring and feedback control method, 301, of the invention. The logic of the method can be used to assay bath constituents in order to determine whether or not to initiate plating, although in a preferred embodiment, method 301 is implemented upon commencement of the plating process. Method 301 begins with sampling a plating bath electrolyte as previously described. See 303. Next, the sample is analyzed by mass spectrometry to give, after data manipulation, a mass spectrum. See 305. The mass spectrum is compared to a database of mass spectra of known standards. See 307. Next in block 309, a decision is made as to whether the spectral result matches a desired target result. If the spectral result matches the target result, then another decision is made whether to continue plating, see block 310. If plating is to continue (based on a timer, or other process monitoring such as amount of metal plated, etc.) then blocks 303–309 are repeated. The frequency of sampling is generally application dependent. That is for example in electroplating, different levels of suppressors or accelerators may be used and their consumption or chemistry dynamics vary with the electroplating cell conditions. However in a preferred method, a new mass spectrum is generated from a plating bath for every cassette of wafers for batch quality control. In a more preferred method, a mass spectrum is generated for every wafer. Most preferably, a mass spectrum is taken multiple times for each wafer processed. If plating is deemed finished, then the plating process is stopped. See block 315. Cessation of plating can mean any plating hardware manipulation that achieves that end. Preferably, plating current is stopped and the wafer and counter electrode are moved away from each other. Once plating is ceased, the logic queries whether a new wafer (or set of wafers depending upon the application) is to be plated, see 317. If not, the method is complete, if so the fully processed wafer (or wafers) is unloaded and an unplated wafer is loaded, see 319. Once the new wafer is loaded, the method begins again at block 303.

Returning to decision block 309, if the spectral result does not match a target result, then the controller commands the hardware to adjust the plating conditions to compensate for the variance from the target result. See 311. Any number of manipulations of the bath chemistry hardware or plating hardware can achieve this. For example a plating bath electrolyte formulation may be adjusted, or a plating current level may be adjusted to decrease or increase consumption of copper ions.

After adjustment of the plating conditions, the system determines whether plating should continue. See 313. It is possible that the detected mass spectra indicates that conditions have degraded to a point where the wafer must be scrapped or specially treated in some manner to reach an acceptable state for further processing. If it is determined at 313 that plating is not to continue, then plating is ceased and so on as described above, see 315–319. In 313, if plating is to continue, then process control returns to blocks 303–309.

The target result is preferably a mass spectrum that corresponds to an optimal bath formulation for the desired plating results. The target result can also be a specific peak or set of peaks in a mass spectrum that correspond to an optimal bath formulation for the desired plating results. Typically, the spectral result does not match the target result exactly, but rather should match within a range of relative abundances of the ions in question. In this way, individual peak intensities for particular species indicate relative ratios of bath constituents, and the bath constituents can be adjusted accordingly, via commands to the bath chemistry hardware.

Embodiments of the present invention employ various processes involving data stored in or transferred through one or more computer systems. Embodiments of the present invention also relate to the apparatus for performing these operations. These apparatus and processes may be employed to monitor plating bath constituents, retrieve stored spectra from databases or other repositories, and adjust the bath constituents or plating hardware. The control apparatus of this invention may be specially constructed for the required purposes, or it may be a general-purpose computer selectively activated or reconfigured by a computer program and/or data structure stored in the computer. The processes presented herein are not inherently related to any particular computer or other apparatus. In particular, various general-purpose machines may be used with programs written in accordance with the teachings herein, or it may be more convenient to construct a more specialized apparatus to perform the required method steps.

In addition, embodiments of the present invention relate to computer readable media or computer program products that include program instructions and/or data (including data structures) for performing various computer-implemented operations. Examples of computer-readable media include, but are not limited to, magnetic media such as hard disks, floppy disks, and magnetic tape; optical media such as CD-ROM disks; magneto-optical media; semiconductor memory devices, and hardware devices that are specially configured to store and perform program instructions, such as read-only memory devices (ROM) and random access memory (RAM). The data and program instructions of this invention may also be embodied on a carrier wave or other transport medium. Examples of program instructions include both machine code, such as produced by a compiler, and files containing higher level code that may be executed by the computer using an interpreter.

Figure 4:
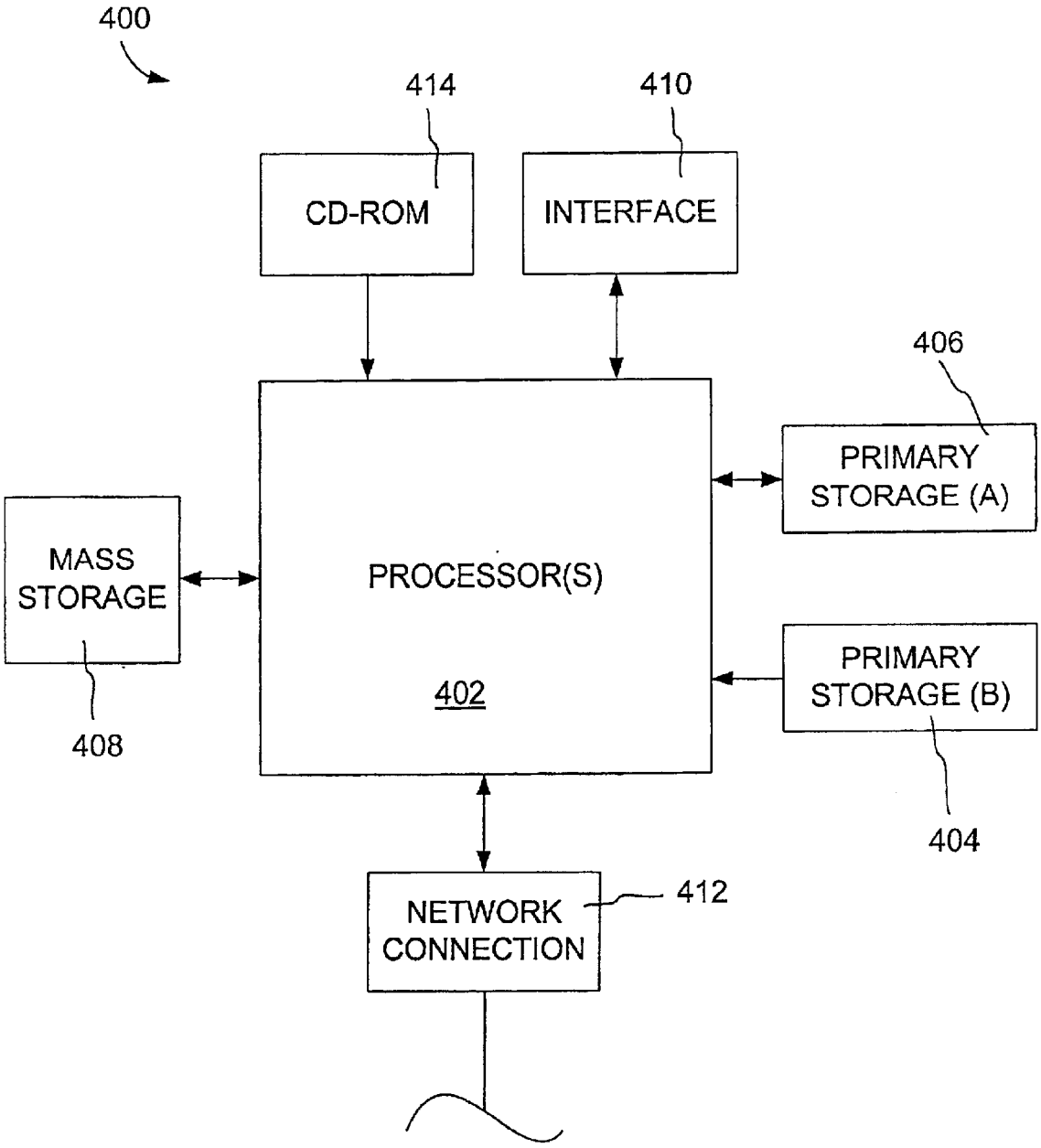
FIG. 4 is a block diagram of a computer system that may be used to implement various aspects of this invention such as manipulating data from a mass spectrometer and using this information to provide feedback to an electroplating apparatus.

FIG. 4 illustrates a typical computer system that, when appropriately configured or designed, can serve as a system controller of this invention. The computer system 400 includes any number of processors 402 (also referred to as central processing units, or CPUs) that are coupled to storage devices including primary storage 406 (typically a random access memory, or RAM), primary storage 404 (typically a read only memory, or ROM). CPU 402 may be of various types including microcontrollers and microprocessors such as programmable devices (e.g., CPLDs and FPGAs) and unprogrammable devices such as gate array ASICs or general purpose microprocessors. As is well known in the art, primary storage 404 acts to transfer data and instructions uni-directionally to the CPU and primary storage 406 is used typically to transfer data and instructions in a bi-directional manner. Both of these primary storage devices may include any suitable computer-readable media such as those described above. A mass storage device 408 is also coupled bi-directionally to CPU 402 and provides additional data storage capacity and may include any of the computer-readable media described above. Mass storage device 408 may be used to store programs, data and the like and is typically a secondary storage medium such as a hard disk. It will be appreciated that the information retained within the mass storage device 408, may, in appropriate cases, be incorporated in standard fashion as part of primary storage 406 as virtual memory. A specific mass storage device such as a CD-ROM 414 may also pass data uni-directionally to the CPU.

CPU 402 is also coupled to an interface 410 that connects to one or more input/output devices such as such as video monitors, track balls, mice, keyboards, microphones, touch-sensitive displays, transducer card readers, magnetic or paper tape readers, tablets, styluses, voice or handwriting recognizers, or other well-known input devices such as, of course, other computers. Finally, CPU 402 optionally may be coupled to an external device such as a database or a computer or telecommunications network using an external connection as shown generally at 412. With such a connection, it is contemplated that the CPU might receive information from the network, or might output information to the network in the course of performing the method steps described herein.

Typically, the computer system 400 is directly coupled to a mass spectrometer and other components of a electroplating apparatus of this invention. For example, the computer system of FIG. 4 may correspond to the computer 221 depicted in FIG. 2. Data from a mass spectrometer is provided via interface 410 for analysis by system 400. With this data, the apparatus 400 can issue various control commands such as adjusting plating bath formulations or cessation of plating.

While this invention has been described in terms of a few preferred embodiments, it should not be limited to the specifics presented above. Many variations on the above-described preferred embodiments may be employed. Therefore, the invention should be broadly interpreted with reference to the following claims.

What is claimed is:

1. A method for controlling an electroplating process, the method comprising:

(a) obtaining a sample of electrolyte from the electroplating process;

(b) analyzing the sample of electrolyte by mass spectrometry to obtain a mass spectral result;

(c) the mass spectral result to a plurality of known mass spectral results; and (d) adjusting conditions of the electroplating process in response to the comparison, wherein adjusting conditions of the electroplating process comprises adjusting electroplating apparatus hardware adapted to control one or more of the following: an electrical current flow, an electrical field shape, a voltage level, a wafer handling apparatus, and a relative orientation of an electrode with a counter electrode.

2. The method of claim 1, wherein the sample of electrolyte is obtained directly from a plating cell of the electroplating process.

3. The method of claim 1, wherein the sample of electrolyte is obtained directly from a separate sampling vessel of the electroplating process.

4. The method of claim 1, wherein the sample of electrolyte is obtained from a central chemistry vessel of the electroplating process.

5. The method of claim 1, wherein the sample of electrolyte is analyzed using atmospheric pressure ionization mass spectrometry.

6. The method of claim 1, wherein the sample of electrolyte is analyzed using at least one mass spectrometry technique selected from the group consisting of API-MS, Quadrupole MS, Ion Trap MS, Magnetic Sector MS, and Time-of-Flight MS.

7. The method of claim 1, wherein the plurality of known mass spectral results is stored in a memory device.

8. The method of claim 7, further comprising determining whether the mass spectral result falls within a specified tolerance of a target result that is one of the plurality of known mass spectral results.

9. The method of claim 1, whether the plurality of known spectral results are provided for a plurality of compositions comprising at least one of organic plating additives and breakdown products of said additives.

10. The method of claim 1, wherein adjusting conditions of the electroplating process further comprises adjusting electroplating apparatus hardware adapted to control an electrolyte composition.

11. The method of claim 1, wherein adjusting conditions of the electroplating process comprises adjusting the electroplating apparatus hardware adapted to control an electrical current flow.

12. The method of claim 1, wherein adjusting conditions of the electroplating process comprises adjusting the electroplating apparatus hardware adapted to control a field shaping apparatus.

13. The method of claim 1, wherein adjusting conditions of the electroplating process comprises adjusting the electroplating apparatus hardware adapted to control a voltage level.

14. The method of claim 1, wherein adjusting conditions of the electroplating process comprising adjusting the electroplating apparatus hardware adapted to control a wafer handling apparatus.

15. The method of claim 1, wherein adjusting conditions of the electroplating process comprises adjusting the electroplating apparatus hardware adapted to control a relative orientation of an electrode with a counter electrode.

16. The method of claim 1, wherein the mass spectral result is obtained for each cassette of wafers processed.

17. The method of claim 1, wherein, the mass spectral result is obtained for each wafer processed.

18. The method of claim 1, wherein, the mass spectral result is obtained multiple times for each wafer processed.

* * * * *